United States Patent [19]

Schlicht

[11] Patent Number: 4,748,708

[45] Date of Patent: Jun. 7, 1988

[54] SPIKE HARROW TOOTH AND METHOD OF MANUFACTURE

[75] Inventor: Larry J. Schlicht, Doran, Minn.

[73] Assignee: Lear Siegler, Inc., Sioux Falls, S. Dak.

[21] Appl. No.: 848,790

[22] Filed: Apr. 7, 1986

[51] Int. Cl.[4] ..... B21G 3/00

[52] U.S. Cl. ..... 10/63; 10/34; 10/35; 10/61; 10/62; 72/356; 72/362

[58] Field of Search ..... 72/352, 356, 353, 362; 10/9, 21, 34, 54, 55, 56, 57, 59, 61, 62, 63, 35, 53

[56] References Cited

U.S. PATENT DOCUMENTS

| | | | |
|---|---|---|---|
| 212,241 | 2/1879 | Loughran . | |
| 228,551 | 6/1880 | Nimmo . | |
| 262,294 | 8/1882 | Hershek . | |
| 265,084 | 9/1882 | Howard . | |
| 282,223 | 7/1883 | Reiner . | |
| 669,258 | 3/1901 | Lanz . | |
| 985,871 | 3/1911 | Whipps . | |
| 1,138,171 | 5/1915 | Ames et al. . | |
| 1,273,760 | 7/1918 | Fragmeier et al. . | |
| 1,408,882 | 3/1922 | Harris . | |
| 1,774,915 | 9/1930 | Crane . | |
| 1,933,559 | 11/1933 | Kovar . | |
| 2,023,636 | 12/1935 | Friedman | 10/63 |
| 2,044,740 | 6/1936 | Stronach | 10/54 |
| 4,493,202 | 1/1985 | Stafford . | |

FOREIGN PATENT DOCUMENTS

| | | | |
|---|---|---|---|
| 15285 | 7/1910 | Denmark | 10/54 |
| 50926 | 7/1911 | Fed. Rep. of Germany | 10/54 |
| 100668 | 4/1922 | Fed. Rep. of Germany | 10/54 |
| 391275 | 4/1933 | United Kingdom | 10/34 |

*Primary Examiner*—Robert L. Spruill
*Assistant Examiner*—Donald R. Studebaker
*Attorney, Agent, or Firm*—Wood, Dalton, Phillips, Mason & Rowe

[57] ABSTRACT

A spike harrow tooth is fabricated by cold forming a metal blank which is provided from appropriate bar stock, the blank having a length for a single harrow tooth. The blank is placed in a first press, oriented with opposite edges of the square configuration aligned in the direction of press closing and opening. The first press is equipped with dies for displacing the metal at one end of the blank, by flattening the opposite edges to thereby displace the metal crosswise and form an enlarged head. Simultaneously, metal is displaced by dies in the first press from opposite side edges of the blank at the other end of the blank for partially forming a point with outwardly bulging excess portions. The partially formed blank then is placed in a second press equipped with dies for removing the outwardly bulging excess portions into waste chips.

3 Claims, 2 Drawing Sheets

FIG. 7
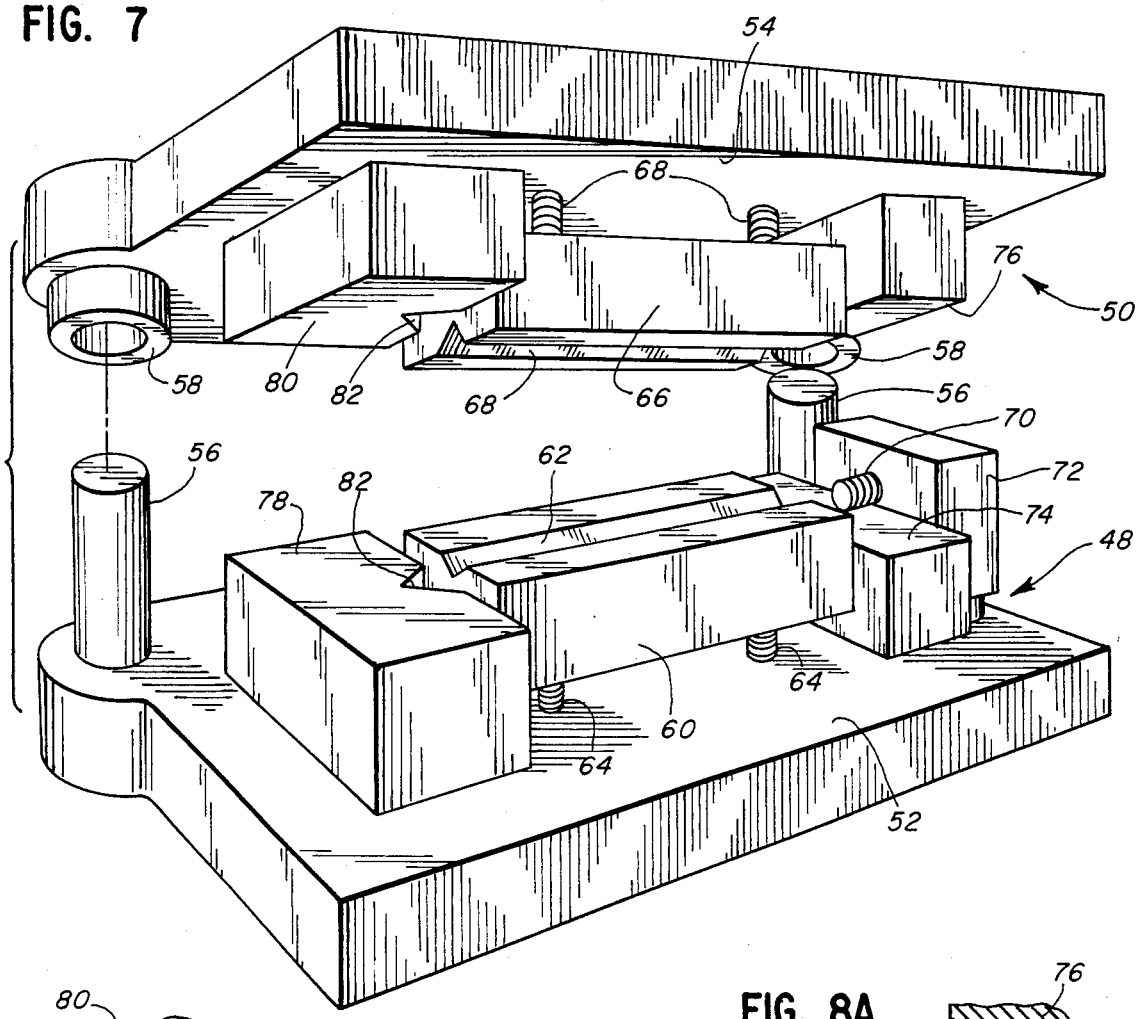
FIG. 8A
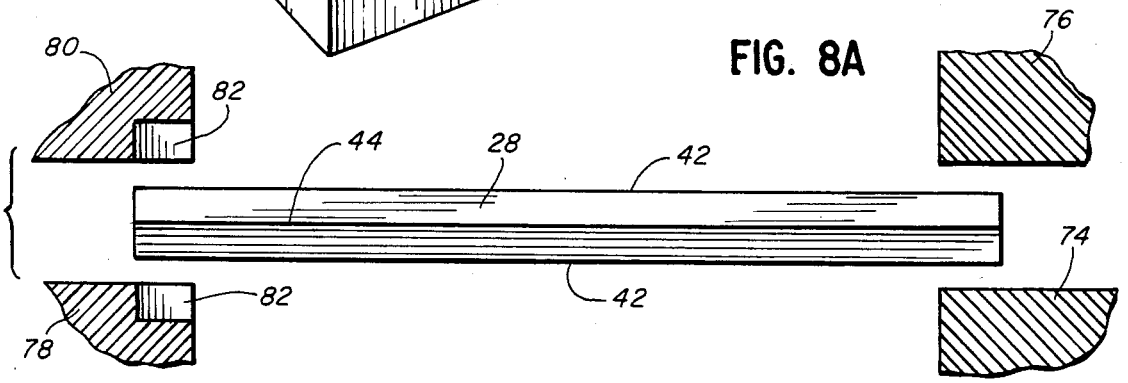
FIG. 8B
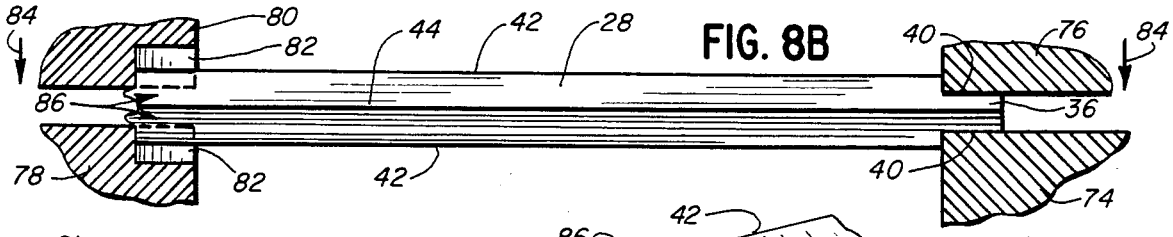
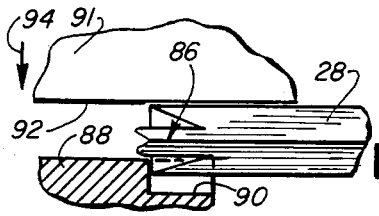
FIG. 10
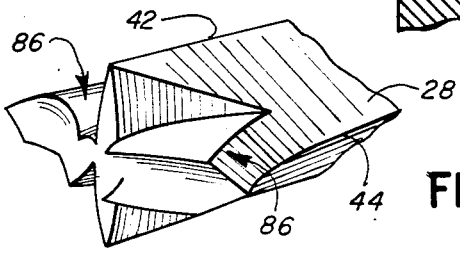
FIG. 9

SPIKE HARROW TOOTH AND METHOD OF MANUFACTURE

BACKGROUND OF THE INVENTION

This invention generally relates to the fabrication of teeth for an agricultural spike-toothed harrow implement and, particularly, to a cold formed spike harrow tooth.

Agricultural spike-toothed harrow implements conventionally include a series of generally parallel, interconnected support bars extending transversely to the direction in which the implement is moved across the ground. Spike harrow teeth are mounted on and project downwardly from the support bars at spaced intervals for working the soil. Conventionally, the teeth are assembled to the support bars by dropping the teeth point-first through holes in the bars, with the teeth having enlarged heads to prevent the teeth from falling completely through the holes. Securing means, such as U-bolts, embrace the teeth and secure the teeth to the support bars, allowing for vertical adjustment of the effective working length of the teeth. Such assemblies not only provide for easy original assembly of the harrow implement, but ready replacement of worn or broken harrow teeth is afforded.

The most prevalent method of fabricating spike harrow teeth of the character described comprises a series of steps involving a hot forming process which is relatively expensive and time consuming. The process starts with hot rolled bar stock usually of square cross-sectional configuration, which is cut at ambient temperature to lengths or blanks which are double the length of a single harrow tooth. The double-length blank then is placed into an oven or furnace to heat only opposite ends of the blank in a localized heating manner. The heated blank then is confined and the ends are hot formed in an inwardly axial direction to form enlarged heads at opposite ends of the double-length blank. The blank then is fed into another oven or furnace which heats only the center of the blank in a localized heating manner. The blank then is hot-formed by drawing the ends of the blank in opposite directions to form opposed points, eventually separating the double-length blank into two individual harrow teeth. The hot teeth are quenched in cooling medium such as water.

The above hot-forming process has been deemed necessary because of the desirability of using metal bar stock of grade C-1045 carbon steel, or the like such as in the range of C-1035 to C-1090. It was believed that such steel would have longer wear, particularly when quenched at the end of the manufacturing process.

It is readily apparent that the above process is quite expensive and time consuming because of the number of steps involved, in addition to the heat expense itself. Other problems also have been encountered in being able to manufacture harrow teeth of consistent configuration. This is important to the ultimate consumer, particularly when replacing worn or damaged harrow teeth in existing agricultural implements. For instance, the amount and/or concentration of heat can actually determine the shape of the harrow teeth points.

It has been found by the instant invention that consistent, substantially identical harrow teeth can be formed by a cold process which is considerably less expensive, eliminating the problems described above, and still using metal such as grade C-1045 carbon steel. Consequently, this invention is directed to the fabrication of spike harrow teeth of the character described in a new and improved cost effective process which eliminates many of the problems described above.

SUMMARY OF THE INVENTION

An object, therefore, of the invention is to provide a new and improved method of cold forming a spike harrow tooth, as well as a spike harrow tooth fabricated according to the inventive method.

In the exemplary embodiment of the invention, a metal blank is provided from appropriate bar stock, the blank having a length for a single harrow tooth. The blank is placed in a first press equipped with dies for displacing the metal at one end of the blank for forming an enlarged head. The first press also is equipped with dies for displacing metal from opposite sides of the blank at the other end of the blank for partially forming a point with outwardly bulging excess portions. The first press then is closed and opened to form the enlarged head and the partially formed point with the outwardly bulging excess portions in a single operation. The partially formed blank then is placed in a second press equipped with dies for removing the outwardly bulging excess portions at the pointed end of the blank. The second press is closed and opened to completely form the point on the blank. Of course, the enlarged head could be formed equally as well in the second press as in the first press, i.e. simultaneously in a single operation with removing the outwardly bulging excess portions.

Preferably, the metal blank is of a generally square cross-section and is provided of hot rolled bar stock of grade C-1045 carbon steel which is processed at ambient temperature. Other steels, such as C-1048 and C-1050, in the range of C-1035 to C-1090 could be used.

With the square metal blank, the blank is placed in the presses oriented with opposite edges of the square configuration aligned in the direction of press closing and opening. The enlarged head is formed in the first press by generally flat dies for flattening opposite edges of the blank to thereby displace the metal crosswise to enlarge the blank at the one end to form the head. The partially formed point is formed in the first press, simultaneously with enlarging the head, by generally V-shaped dies which coin the side edges of the square to form outwardly bulging excess portions. The excess portions are removed by generally V-shaped dies in the second press which forge the excess portions into waste chips.

It can be seen that the method of this invention is effective to cold form spike harrow teeth from bar stock of carbon steel in two simple press operations which result in consistent, if not identical, harrow teeth configurations. The expensive steps in the hot forming processes presently deemed necessary for fabricating long wearing harrow teeth have been completely eliminated.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which

FIG. 7 is a perspective view of the dies of the first press used in fabricating the harrow tooth of the invention;

FIG. 8A illustrates fragmented portions of the dies which engage the blank in the first press, prior to closing;

FIG. 8B is a view similar to that of FIG. 8A, with the dies of the first press closed;

FIG. 9 is a perspective view of the partially formed pointed end of a harrow tooth after processing by the first press; and FIG. 10 is a view similar to the left-hand end of FIG. 8A, illustrating the engaging die portions of the second press for completely forming the pointed end of the harrow tooth.

DESCRIPTION OF THE PREFERRED EMBODIMENT

Figure 1:
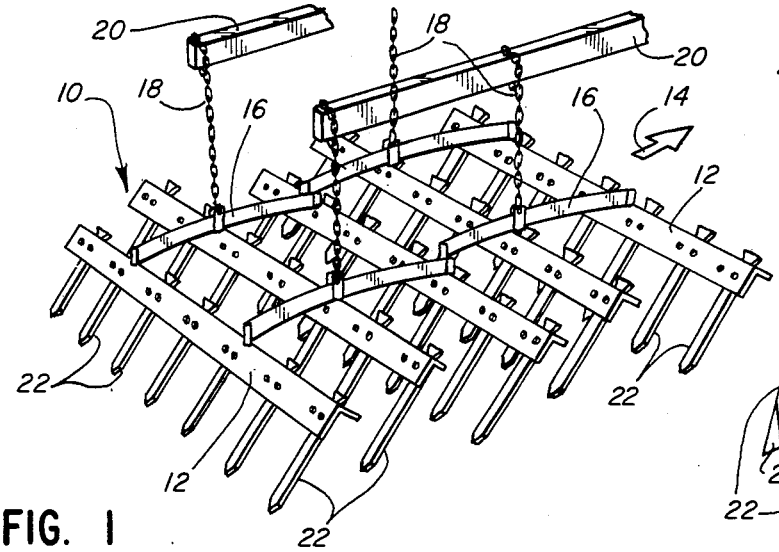
FIG. 1 is a perspective view of a conventional agricultural spike-toothed harrow implement.

Referring to the drawings in greater detail, and first to FIG. 1, a conventional agricultural spike-toothed harrow implement, generally designated 10, is illustrated and includes a plurality of frame portions or cross bars 12 which are generally parallel and extend transverse to the direction of movement of the implement over the ground, as indicated by arrow 14, for working the soil. Cross bars 12 are interconnected by support arms 16 suspended by chains 18 from frame arms 20 extending rearwardly from a tractor or other pulling vehicle. A series of spiked harrow teeth 22 are mounted on and supported by cross bars 12 whereby the teeth project downwardly for working the soil.

Figure 2:
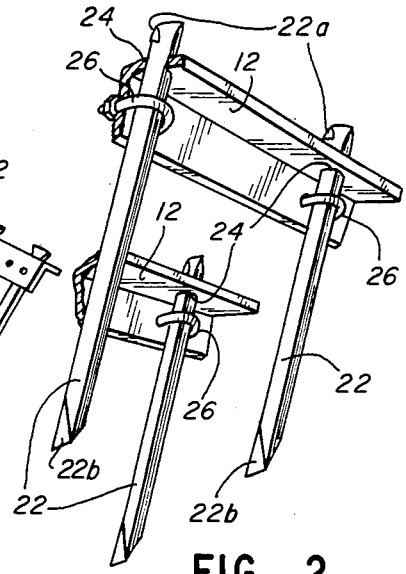
FIG. 2 is an enlarged, fragmented perspective view illustrating the manner in which the harrow teeth are mounted on the implement.

FIG. 2 shows a conventional assembly of harrow teeth 22 on cross bars 12. It can be seen that the cross bars are of angled or L-shaped configurations. Holes 24 are formed at equally spaced intervals through the upper leg of the L-shaped cross bars. During assembly or replacement of harrow teeth 22, the teeth simply are dropped through holes 24. To that end, the teeth are provided with enlarged head portions 22*a* so that the teeth do not drop through holes 24. Each tooth is fixed in position by a U-bolt 26 which embraces the tooth and rigidly secures the tooth to the downwardly depending leg portion of cross bars 12. In this manner, the harrow teeth can be adjusted and held in desired vertical positions to vary the effective length of the teeth respective to their cross bars 12. The opposite ends of the harrow teeth are pointed, as at 22*b*, for working the soil.

Figure 3:
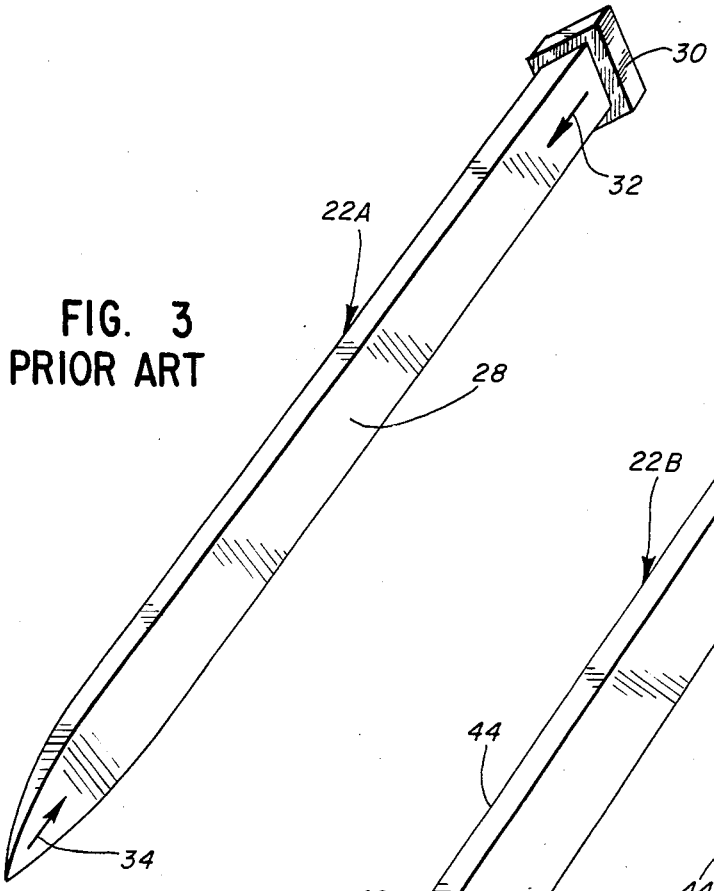
FIG. 3 PRIOR ART
FIG. 3 is an enlarged perspective view of a harrow tooth fabricated according to the prior art.

FIG. 3 shows a harrow tooth, generally designated 22A, fabricated according to prior art processes. As described in detail above, harrow tooth 22A is formed by initially providing generally square bar stock 28 of hot rolled grade C-1045 carbon steel in a blank having twice the length of a single harrow tooth. The double-length blank is placed in an oven or furnace to heat only opposite ends of the blank whereafter a head 30 is hot formed at each end of the double-length blank by forces aplied to the blank, such as in the direction of arrow 32. After the heads 30 are hot formed on the opposite ends of the double-length blank, the blank then is placed in another oven or furnace for heating only the center area of the blank in a localized manner. The double-length blank then is drawn in opposite directions, such as indicated by arrow 34, to hot form opposing points at the middle of the blank to form two harrow teeth. The hot teeth then are quenched in a cooling medium, such as water.

Figure 4:
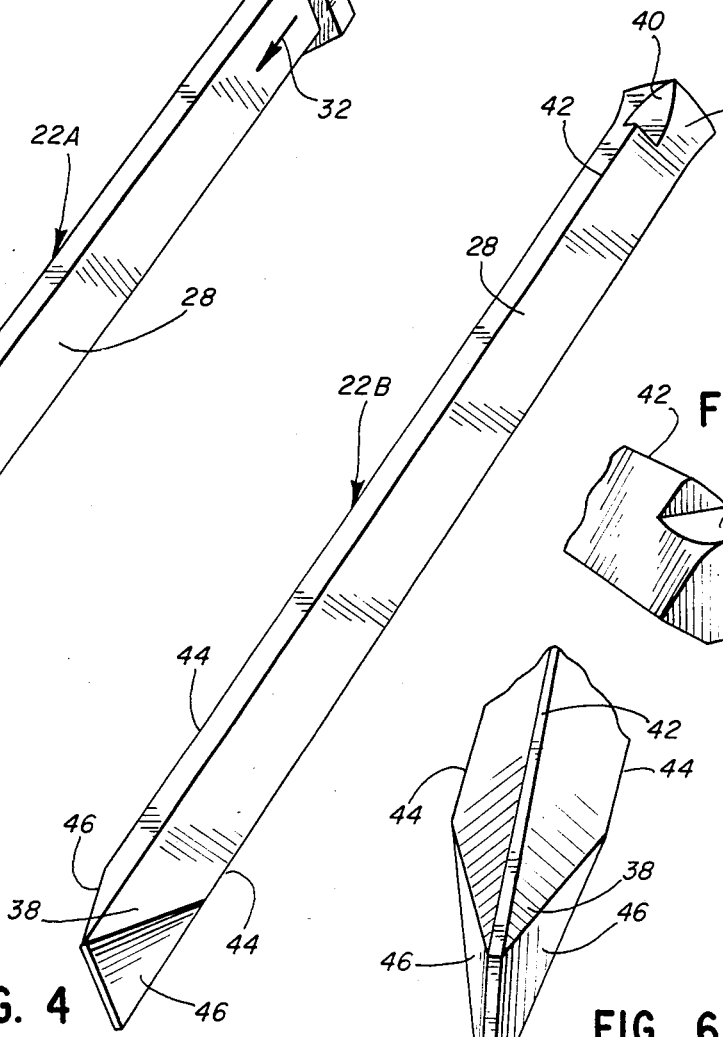
FIG. 4 is an enlarged perspective view of a harrow tooth fabricated according to the invention.
Figure 5:
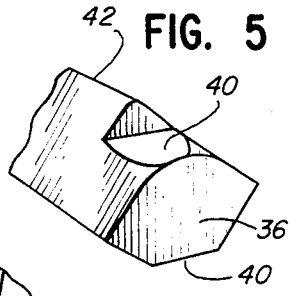
FIG. 5 is a fragmented perspective view of the enlarged head end of the harrow tooth of the invention.
Figure 6:
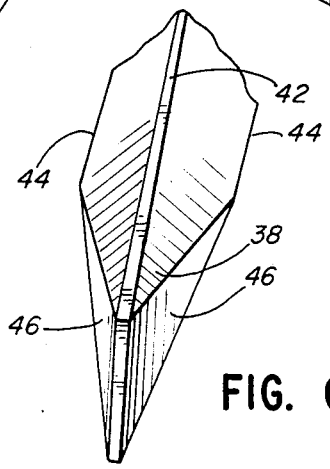
FIG. 6 is a perspective view of the pointed end of the harrow tooth of the invention.

FIGS. 4–6 show a harrow tooth, generally designated 22B, fabricated according to the invention. Again, the tooth is fabricated from hot rolled square bar stock 28 of grade C-1045 carbon steel, it being understood that steels in the C-1035 to C-1090 range could be used, such as C-1048 and C-1050 steels. However, harrow tooth 22B, according to the invention, is completely fabricated by a cold forming process which will be described in greater detail hereinafter. Suffice it to say at this point, harrow tooth 22B is cold formed with an enlarged head portion 36 at one end and a point 38 at the other end. Enlarged head 36 is formed by dies which flatten, as at 40, opposite edges 42 of the square configuration to displace metal and thereby enlarge the head. Pointed end 38 is formed by coining and forging side edges 44 of the square configuration to displace metal, as at 46, to form the pointed end of the harrow tooth.

Turning to FIG. 7, harrow tooth 22B of this invention is cold formed by the use of first and second presses equipped with dies for displacing the metal at opposite ends of the harrow tooth to form enlarged head 36 and point 38. FIG. 7 illustrates the die assemblies of the first press.

More particularly, the first press includes a lower die assembly, generally designated 48, and an upper die assembly, generally designated 50. Conventionally, lower die assembly is mounted in a stationary or fixed position on the fixed table of a conventional press by appropriate clamp means which engage a base plate 52. Similarly, upper die assembly 50 is clamped to an upper, vertically reciprocating head of the press by appropriate means clamping onto a base plate 54. A pair of vertical guide posts 56 project upwardly from base plate 52 of lower die assembly 48 and are telescopingly received within bosses 58 which are integral with and depend from base plate 54 of upper die assembly 50. Guide posts 56 and bosses 58 align lower and upper die assemblies 48 and 50, respectively, during closing and opening of the press.

Lower die assembly 48 includes a center die block 60 having a V-shaped groove 62 extending lengthwise thereof. Die block 60 is spring loaded by coil springs 64. Similarly, upper die assembly 50 has a center die block 66 having a V-shaped groove 68 extending lengthwise thereof. Die block 66 is spring loaded by coil springs 68. The V-shaped grooves 62 and 68 of lower and upper die blocks 60 and 66, respectively, are configured for receiving a metal blank of square bar stock 28 (FIG. 4) with edges 42 (FIGS. 4–6) aligned in the direction of press closing and opening. A spring loaded stud 70 projects axially inwardly from a mounting block 72 extending upwardly of base plate 52 of lower die assembly 48. The spring loaded stud is aligned with V-shaped groove 62 and positions the metal blank in proper axial location.

In order to form flattened areas 40 (FIGS. 4 and 5) to form enlarged heads 36, a pair of flat die blocks 74 and 76 are provided on die assemblies 48 and 50, respectively, at one end of die blocks 60 and 66, respectively.

In order to partially form points 38 at the first press, a pair of die blocks 78 and 80 are provided on base plates 52 and 54, respectively, of lower die assemblies 48 and 50, respectively. Each die block 78,80 is provided with a vertically oriented V-shaped groove or notch 82 in axial alignment with V-shaped grooves 62 and 68 of lower center die blocks 60 and 66, respectively, of lower and upper die assemblies 48 and 50, respectively.

From the foregoing and as further illustrated in FIGS. 8A and 8B, the method of cold forming a spike harrow tooth according to the invention can be readily understood. Specifically, a metal blank 28 (FIG. 8A) is positioned with the square configuration of the blank aligned in the direction of press opening and closing. The opposing flat surfaces of die blocks 74 and 76 are aligned with one end of the metal blank. The V-shaped notches 82 of die blocks 78 and 80 are aligned with the other end of metal blank 28.

When the metal blank is properly positioned as described above, the press closes upper die assembly 50 toward lower die assembly 48 as indicated by arrows 84 (FIG. 8B). The opposing flat faces of die blocks 74 and 76 thereupon flatten edges 42 of blank 28 at the one end of the blank to displace the metal and form enlarged head 36 to the configuration illustrated in FIGS. 4 and 5. Simultaneously, in the same operation, V-shaped notches 82 in die blocks 78 and 80 partially form the point of the harrow tooth at the other end of blank 28. This is best seen in FIG. 9 wherein it can be seen that outwardly bulging excess portions, generally designated 86, have been formed during the first press operation by displacing the metal along edges 44 of the square configuration of blank 28.

The blank or partially formed harrow tooth then is placed in a second press which is equipped with dies as illustrated in FIG. 10. More particularly, the press includes lower and upper die assemblies mounted in the press somewhat similar to lower and upper die assemblies 48 and 50 as illustrated in FIG. 7. All of the details are not illustrated in order to avoid cluttering the illustration. However, the lower die assembly of the second press includes a die block 88 somewhat similar to die block 78 (FIG. 7) including a vertically oriented V-shaped notch 90 which is placed in identical location to V-shaped notch 82 in die block 78 (FIG. 7). Notch 90 must be at least as deep as, or preferably slightly deeper than, the thickness of bulging excess portions 86. An upper die block 91 of an upper, reciprocating die assembly includes a lower flat surface 92 which engages the top of blank 28. On actuating the press to drive the upper die assembly, including die block 91, downwardly in the direction of arrow 94, the V-shaped notch 90 in lower die block 88 is effective to shear or forge outwardly bulging excess portions 86 into waste chips and completely form point 38 by completely displacing metal as indicated at 46 in FIG. 6.

It should be understood that enlarged head 36 could be formed in the second press equally well as in the first press. In other words, die blocks such as flat die blocks 74 and 76 would be placed in the second press at the end of the spike harrow tooth opposite die blocks 88 and 91. The enlarged head then would be formed simultaneously in a single operation with shearing outwardly bulging excess portions 86 into waste chips.

From the foregoing, it can be seen that the complete harrow tooth 22B (FIG. 4) has been cold formed in two simple press operations without any heating required of the metal blank. All of the extraneous steps of the processes presently used in order to incorporate such wearable metals as grade C-1045 carbon steel have been eliminated. The process of this invention, resulting in the novel harrow tooth described above, is extremely cost effective and results in harrow teeth manufacturable in large quantities of consistent, substantially identical configurations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of cold forming a spike harrow tooth, comprising the steps of:

providing a carbon steel metal blank of generally square bar stock, the blank having a length for a single harrow tooth;

placing the blank in a first press oriented with opposite edges of the square configuration aligned in the direction of press closing and opening, the first press being equipped with dies for displacing metal from opposite side edges of the square at one end of the blank for partially forming a point with outwardly bulging excess portions;

closing and opening the first press to partially form said point with said outwardly bulging excess portions;

placing the partially formed blank in a second press again with said opposite edges of the square configuration aligned in the direction of press closing and opening, the second press being equipped with dies for removing said outwardly bulging excess portions;

closing and opening the second press to completely form the point at said one end of the blank; and providing one of said first and second presses with generally flat dies for flattening at least one of said opposite edges to thereby displace the metal crosswise to enlarge the blank at the other end of the blank and for an enlarged head in a single operation with the step performed at the one press.

2. The method of claim 1 wherein the partially formed point is formed by generally V-shaped dies of the first press for coining the side edges of the square to form said outwardly bulging excess portions.

3. The method of claim 2 wherein said excess portions are removed by generally V-shaped dies of the section press for forging the excess portions into waste chips.

* * * * *